US011293682B2

(12) United States Patent
LoVerde et al.

(10) Patent No.: US 11,293,682 B2
(45) Date of Patent: Apr. 5, 2022

(54) METHOD OF MODIFYING TEMPERATURES OF MULTIPLE OBJECTS AND APPARATUS THEREFOR

(71) Applicant: Purdue Research Foundation, West Lafayette, IN (US)

(72) Inventors: Mitchell Anthony LoVerde, Spring, TX (US); David Stephen Page, Indianapolis, IN (US); Kyle Chang Ma, Naperville, IL (US); Scott Robert Lancaster, Indianapolis, IN (US); Christopher James Mead, Farmington Hills, MI (US)

(73) Assignee: Purdue Research Foundation, West Lafayette, IN (US)

( * ) Notice: Subject to any disclaimer, the term of this patent is extended or adjusted under 35 U.S.C. 154(b) by 0 days.

(21) Appl. No.: 16/395,441

(22) Filed: Apr. 26, 2019

(65) Prior Publication Data

US 2019/0331392 A1 Oct. 31, 2019

Related U.S. Application Data

(60) Provisional application No. 62/663,727, filed on Apr. 27, 2018.

(51) Int. Cl.

| | |
|---|---|
| ***F25D 17/02*** | (2006.01) |
| ***F25D 25/04*** | (2006.01) |
| ***F25D 31/00*** | (2006.01) |
| ***F25D 3/06*** | (2006.01) |

(52) U.S. Cl.

CPC ..... *F25D 17/02* (2013.01); *F25D 3/06* (2013.01); *F25D 25/04* (2013.01); *F25D 31/007* (2013.01)

(58) Field of Classification Search

CPC . F25D 17/02; F25D 3/06; F25D 25/04; F25D 31/007; F25D 17/00; F25D 2331/805; F25D 3/02; F25D 2400/28

USPC ..... 62/64

See application file for complete search history.

(56) References Cited

U.S. PATENT DOCUMENTS

| | | | | |
|---|---|---|---|---|
| 511,209 | A | 12/1893 | Parker | |
| 2,405,091 | A * | 7/1946 | Culbreth | F25D 31/007 62/376 |
| 2,959,925 | A * | 11/1960 | Frantti | H01L 35/00 62/3.3 |
| 4,825,665 | A * | 5/1989 | Micallef | F25D 3/06 62/372 |
| 9,080,803 | B2 | 7/2015 | Wheeland et al. | |
| 9,434,918 | B1 * | 9/2016 | Narasimhan | C12H 1/16 |
| 9,810,473 | B2 * | 11/2017 | Lauchnor | F25C 5/20 |

(Continued)

*Primary Examiner* — Cassey D Bauer

(74) *Attorney, Agent, or Firm* — Hartman Global IP Law; Gary M. Hartman; Domenica N. S. Hartman

(57) ABSTRACT

Methods and apparatuses for transferring heat to and from multiple objects. Such a method entails placing objects in a vessel that contains a heat transfer fluid so that the objects contact the heat transfer fluid. The heat transfer fluid is at a temperature that is different from the temperature of the object, and is induced to circulate along a continuous flowpath. Each object is at least partially disposed in the flowpath of the heat transfer fluid, and each object is individually rotated about an axis of rotation thereof. The heat transfer fluid continues to circulate and the objects continue to rotate for a time sufficient to cause the temperatures of the objects to become closer to the heat transfer fluid temperature.

7 Claims, 7 Drawing Sheets

(56) References Cited

U.S. PATENT DOCUMENTS

| | | | | |
|---|---|---|---|---|
| 2008/0178623 | A1* | 7/2008 | Cunningham | F25D 7/00 62/244 |
| 2011/0005265 | A1* | 1/2011 | Edwards | F25D 31/007 62/465 |
| 2013/0233011 | A1* | 9/2013 | Wolf | F25D 3/08 62/457.5 |
| 2014/0360711 | A1* | 12/2014 | Parker | F25D 31/007 165/185 |
| 2015/0198363 | A1* | 7/2015 | Lee | F25D 31/007 62/377 |
| 2015/0233631 | A1* | 8/2015 | Shuntich | F25D 3/08 62/64 |
| 2016/0097577 | A1* | 4/2016 | Lauchnor | F25D 31/007 62/185 |
| 2016/0109176 | A1* | 4/2016 | Harms | F25D 3/08 62/457.5 |
| 2016/0209111 | A1* | 7/2016 | Jafa | F25D 31/007 |
| 2018/0235392 | A1* | 8/2018 | Yuki | F25B 21/02 |
| 2018/0240229 | A1* | 8/2018 | Yuki | C12H 1/22 |
| 2018/0252446 | A1* | 9/2018 | Place | F25D 31/002 |

* cited by examiner

METHOD OF MODIFYING TEMPERATURES OF MULTIPLE OBJECTS AND APPARATUS THEREFOR

CROSS-REFERENCE TO RELATED APPLICATIONS

This application claims the benefit of U.S. Provisional Application No. 62/663,727 filed Apr. 27, 2018. The contents of this prior application are incorporated herein by reference.

BACKGROUND OF THE INVENTION

The present invention generally relates to methods and apparatuses for transferring heat to and from an object. The invention particularly relates to methods and apparatuses capable of simultaneously modifying the temperatures of multiple objects, as a nonlimiting example, multiple containers containing liquids.

A cooler is generally understood to be a portable chest, box, etc., that is insulated to keep foods, drinks, or other perishable items at a desired temperature, typically though not necessarily at a temperature that is cooler than the environment surrounding the cooler. Coolers are widely used under circumstances in which access to electrical power is limited or not possible. Conventionally, inexpensive coolers have been constructed from expanded polystyrene foam insulation (for example, STYROFOAM®) or an inexpensive plastic, while more expensive coolers are often constructed to have durable walls that are insulated and sometimes vacuum sealed.

The utility of a cooler is often judged by how long it is able to keep an item cold for an extended period of time. While existing coolers are quite successful in this regard, traditional coolers do not satisfy another important metric: the heat transfer rate to or from an item, for example, the rate at which a beverage in a container is cooled to a desired temperature (for example, about 34 to 35° F., or about 1 or 2° C.) after being placed in a cooler containing a heat sink, typically ice or a mixture of ice and water. Heat is transferred by conduction, convection, and radiation. Within the confines of a cooler, however, heat transfer by radiation is negligible and convective heat transfer is limited due to a lack of relative motion between beverage containers and heat sink within a traditional cooler. Therefore, to increase the rate at which a cooler is able to cool a beverage container (or other item), conductive and/or convective heat transfer must be augmented between the beverage container and heat sink. One such approach is exemplified by a product commercially available from ApexTek Labs, Inc., under the name SPINCHILL®. Whereas the core of a liquid within a container ordinarily remains stationary when the container is placed in a traditional cooler, the SPINCHILL® product promotes convective heat transfer between the liquid and its container to promote the overall heat transfer rate between the liquid and a heat sink in which the container is placed. However, the SPINCHILL® product is a handheld device that requires electrical power, is limited to use with a single beverage container at any given time, and is not configured for storing the container.

BRIEF DESCRIPTION OF THE INVENTION

The present invention provides methods and apparatuses suitable for transferring heat to and from multiple objects, and particularly suitable for simultaneously heating or cooling liquids contained in multiple containers, as a nonlimiting example, beverage containers.

According to one aspect of the invention, a method of modifying temperatures of multiple objects entails placing the objects in a vessel that contains a heat transfer fluid so that the objects contact the heat transfer fluid. The heat transfer fluid is at a temperature that is different from the temperature of the object. The heat transfer fluid in the vessel is induced to circulate along a continuous flowpath, each object is at least partially disposed in the flowpath of the heat transfer fluid, and each object is individually rotated about an axis of rotation thereof. The heat transfer fluid continues to circulate and the objects continue to rotate for a time sufficient to cause the temperatures of the objects to become closer to the heat transfer fluid temperature.

According to another aspect of the invention, an apparatus for modifying temperatures of multiple objects includes a vessel configured to contain a heat transfer fluid, and multiple means for individually securing each of the multiple objects within the vessel so that the objects will contact the heat transfer fluid when contained by the vessel. Each securing means has an axis of rotation. The apparatus further includes means for inducing the heat transfer fluid in the vessel to circulate along a continuous flowpath within the vessel. The securing means secure the objects so that each of the objects is at least partially disposed in the flowpath of the heat transfer fluid. The apparatus also includes means for individually rotating each object about a corresponding one of the axes of rotation of the securing means.

Technical aspects of methods and apparatuses as described above preferably include the ability to promote convective heat transfer between multiple objects and a heat source or sink to promote convective heat transfer therebetween. If the objects are containers that each contain a liquid, the methods and apparatuses as described above also promote convective heat transfer between the containers and the liquids they contain, such that the liquids benefit from significant convective heat transfer. Such a capability finds uses in a variety of applications, a nonlimiting example of which is quickly cooling multiple beverage containers.

Other aspects and advantages of this invention will be appreciated from the following detailed description.

DETAILED DESCRIPTION OF THE INVENTION

Figure 1:
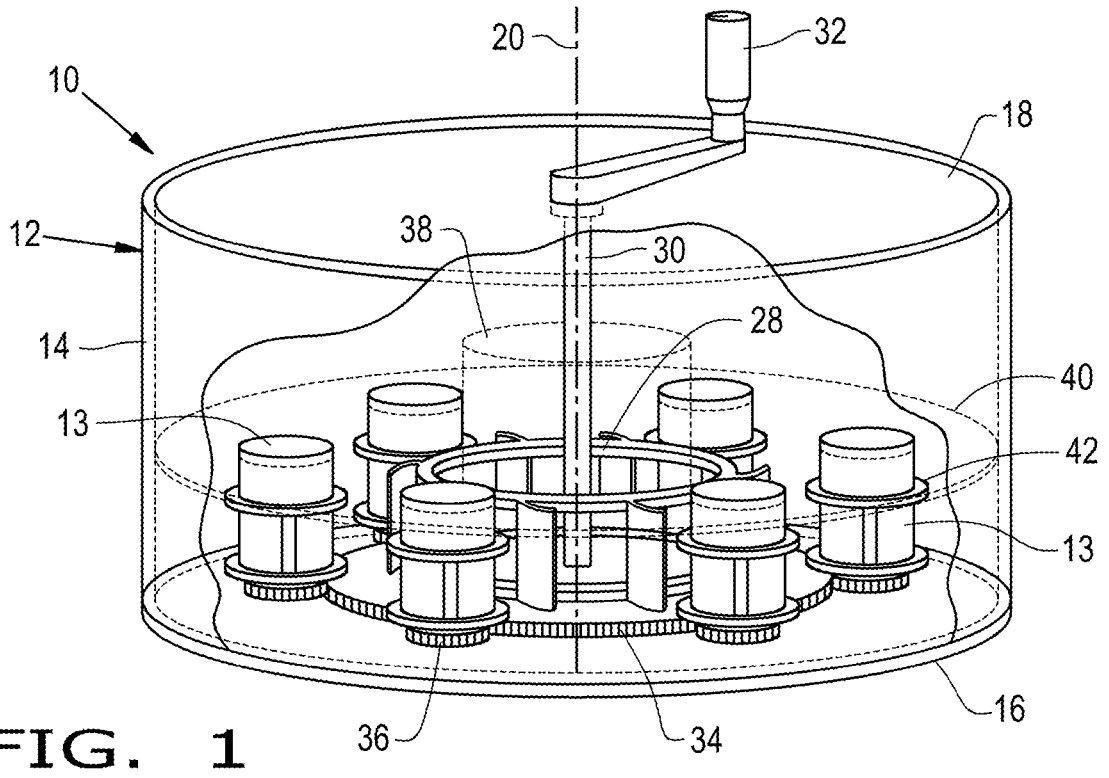
FIGS. 1 and 2 schematically represent perspective and top views of a heat transfer apparatus in accordance with a nonlimiting embodiment of this invention, with structural components of the apparatus being shown as translucent to reveal internal components of the apparatus.
Figure 2:
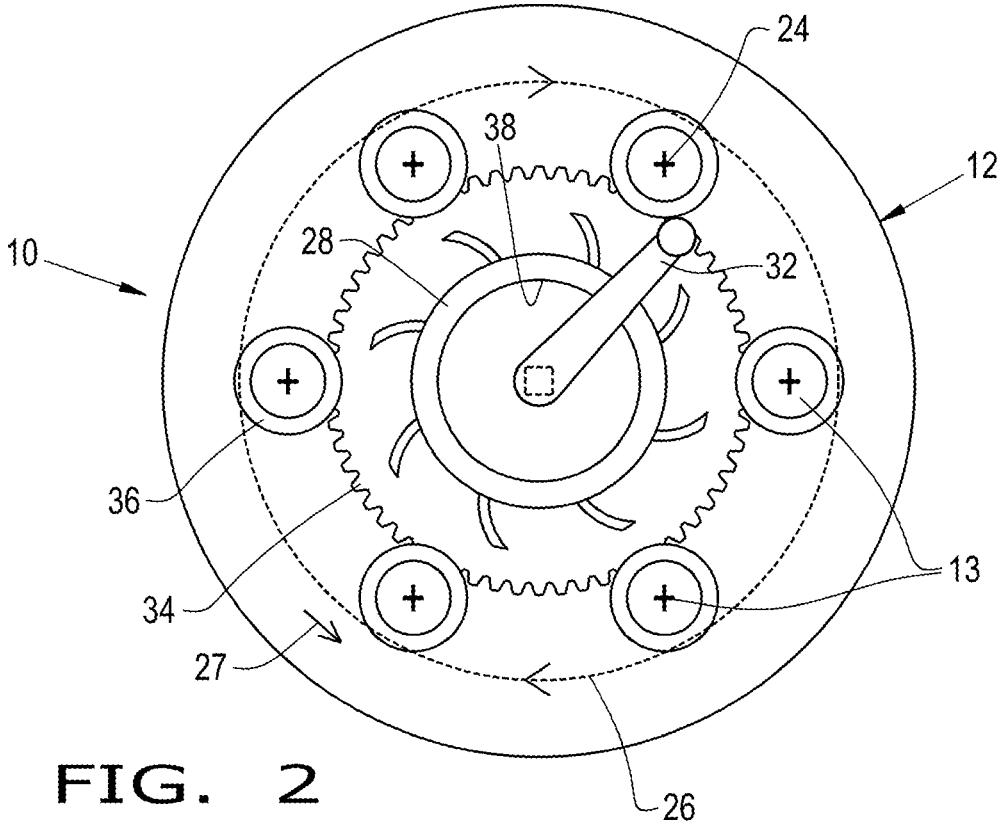
Figure 3:
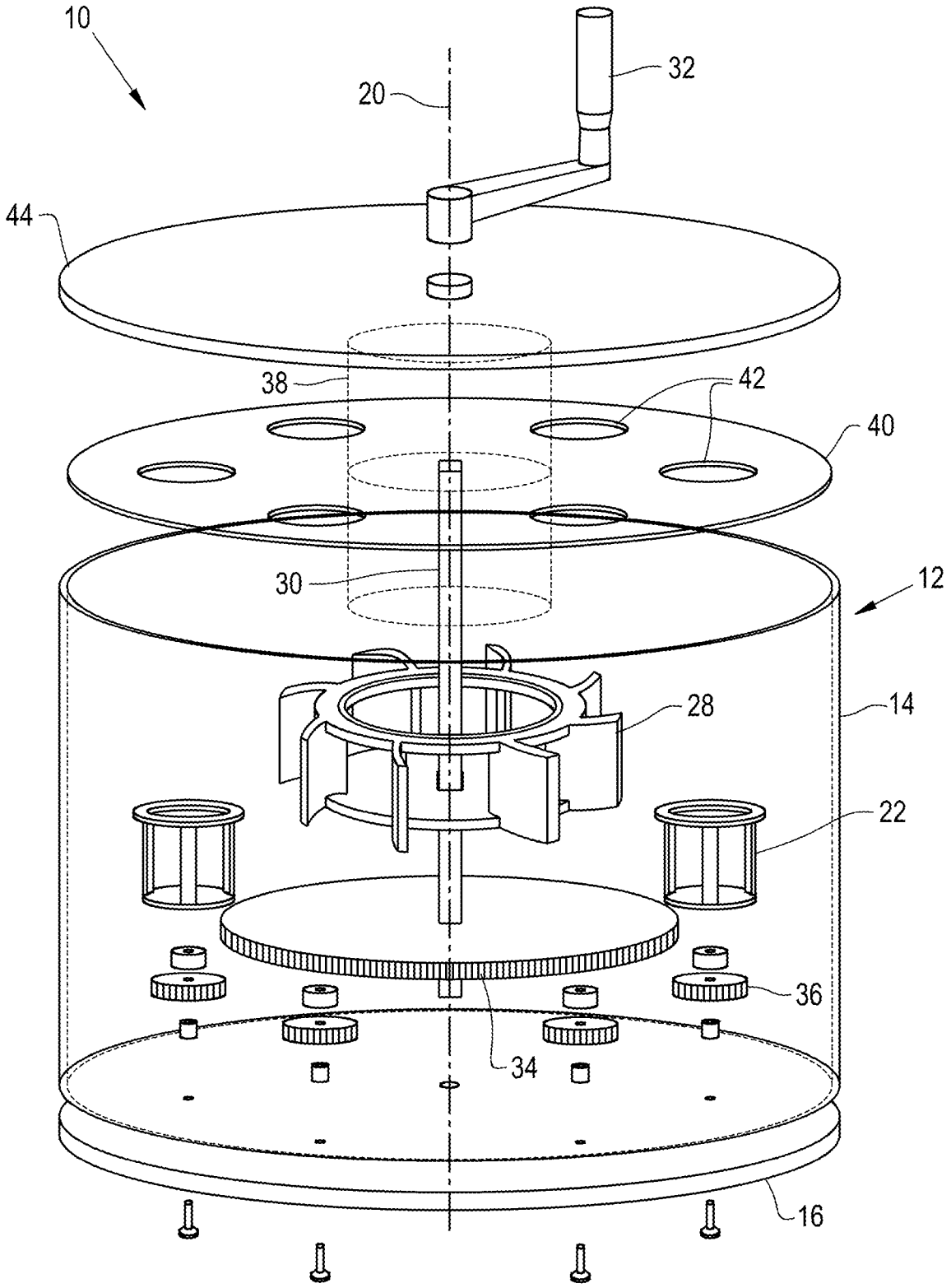
FIG. 3 schematically represents a perspective exploded view of the heat transfer apparatus of FIGS. 1 and 2, with structural components of the apparatus being shown as translucent to reveal internal components of the apparatus.

FIGS. 1 through 3 represent various views of a heat transfer apparatus 10 in accordance with a nonlimiting embodiment of this invention. To facilitate the description provided below of the apparatus 10 represented in the drawings, relative terms, including but not limited to, "vertical," "horizontal," "lateral," "front," "rear," "side," "forward," "rearward," "upper," "lower," "above," "below," "right," "left," etc., may be used in reference to an orientation of the apparatus 10 during its operation. Furthermore, on the basis of a coaxial arrangement of certain components of the apparatus 10, relative terms including but not limited to "axial," "circumferential," "radial," etc., and related forms thereof may also be used below to describe the nonlimiting embodiment represented in the drawings. All such relative terms are intended to indicate the construction and relative orientations of components and features of the apparatus 10, and therefore are relative terms that are useful to describe the illustrated embodiment but should not be necessarily interpreted as limiting the scope of the invention.

The apparatus 10 comprises several different subsystems, each having a functional role in the apparatus 10 generally along the lines of containment, rotation, insulation, actuation, and storage. The apparatus 10 comprises a vessel 12 adapted and configured to contain a heat transfer fluid (not shown) as a heat source or heat sink. For cooling beverage containers, for example, standard twelve-ounce and 330 ml "cans," a suitable heat transfer fluid is water chilled to near the freezing temperature ("ice water"), though the use of other fluids is foreseeable. The vessel 12 is represented in the drawings as having a cylindrical shape defined by an annular-shaped outer wall 14 and a closed base wall 16, which together define a cylindrical-shaped cavity 18 for receiving the heat transfer fluid. However, it should be apparent that the vessel 12 is not limited to having a cylindrical exterior or interior (cavity) shape. The walls 14 and 16 are preferably thermally insulated with and/or formed of any suitable type of insulation material. The vessel 12 can be seen to have a central axis 20 that, in the represented embodiment, is an axis of axial symmetry of the vessel 12. However, axial symmetry is believed to be a desirable but not required characteristic of the vessel 12 represented in FIGS. 1 through 3.

In the nonlimiting embodiment represented in FIGS. 1 through 3, six sockets or holders 22 are provided as means for individually securing six objects, represented in FIG. 1 as beverage containers (cans) 13 though a wide variety of other objects could be utilized. The holders 22 may be preferably adjustable to accommodate objects of different sizes. As shown, the holders 22 are located in the vessel 12 so that objects secured in the holders 22 will contact a heat transfer fluid contained by the vessel 12. In the nonlimiting embodiment of FIGS. 1 through 3, each holder 22 has an axis of rotation 24 that is approximately parallel to the axis 20 of the vessel 12 (represented as vertical in the drawings), and each holder 22 is mounted within the vessel 12 to rotate about its axis of rotation 24, as will be discussed below. The holders 22 can be seen in FIGS. 1 through 3 as circumferentially spaced from each other around the axis 20 of the vessel 12, and are radially spaced from the axis 20 of the vessel 12. While the holders 22 are shown in the drawings as being uniformly spaced from each other and from the axis 20 of the vessel 12, other configurations are foreseeable. In addition, various configurations are foreseeable for the holders 22. Suitable configurations for the holders 22 are only limited by their ability to secure a particular type of object desired to be cooled (or heated).

The apparatus 10 is further equipped with means for inducing circulation of a heat transfer fluid in the vessel 12 so that the fluid circulates along a continuous flowpath 26, which in the nonlimiting embodiment of FIGS. 1 through 3 is represented as being in a rotational direction around the axis 20 of the vessel 12. In the drawings and particularly FIG. 2, the flowpath 26 can be seen to have an annular or toroidal shape circumscribed by the walls 14 and 16 of the vessel 12 and surrounding an impeller 28 located coaxially with the axis 20 of the vessel 12, such that the direction of flow of the flowpath 26 is a circumferential direction of the vessel 12. The holders 22 are located within the vessel 12 to secure objects so that each object is at least partially and preferably entirely disposed in the flowpath 26 of a heat transfer fluid within the vessel 12. As should be evident from the drawings, rotation of the impeller 28 (for example, in the clockwise direction as viewed in FIG. 3) causes a heat transfer fluid in the vessel 12 to circulate along the flowpath 26 in a clockwise rotational direction around the axis 20 of the vessel 12.

Figure 8:
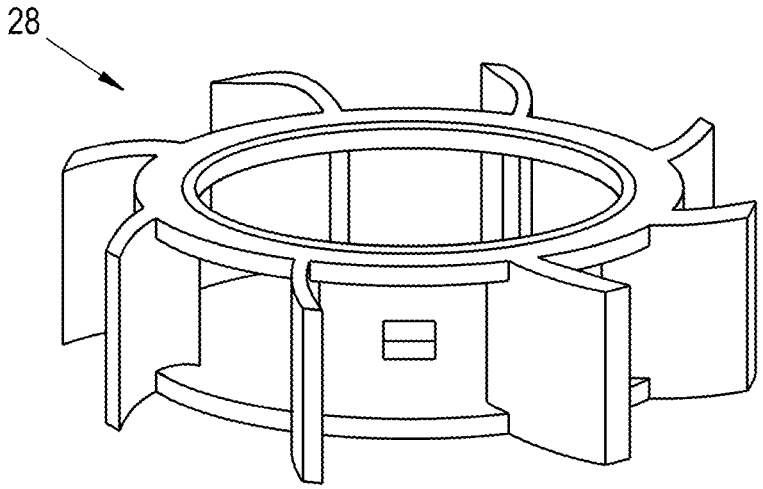
FIG. 8 contains top, front, and side views of an impeller for inducing rotational circulation of a heat transfer fluid contained within the apparatus of FIGS. 1 through 3 in accordance with a nonlimiting aspect of the invention.

Various configurations are foreseeable for the impeller 28, a nonlimiting example of which is represented in FIG. 8. The impeller 28 is represented in FIGS. 1 through 3 as being connected to an input shaft 30, which in turn is connected to a crank handle 32 such that rotation of the impeller 28 (and therefore inducement of the rotational flow) can be manually performed. However, it is also within the scope of the invention that rotation could be driven by a motor, power tool, or any other means capable of providing torque to the input shaft 30.

The apparatus 10 is also equipped with means for individually rotating each holder 22 (and an object secured therein) about its axis of rotation 24. In the nonlimiting embodiment shown in the drawings, such a means is provided by a gear set that transfers the rotation of the impeller 28 to the holders 22. The gear set comprises a drive gear 34 coupled to the impeller 28 and/or the input shaft 30, and driven gears 36 individually coupled to the holders 22. With this arrangement, the drive gear 34 causes each driven gear 36 (and therefore also its corresponding holder 22 and object secured therein) to rotate in a rotational direction 27 that is opposite the rotational direction of the drive gear 34 (in the present example, a counterclockwise rotational direction 27 about their axes 24), and therefore opposite the flow direction of the fluid along the flowpath 26 as induced by the impeller 28. In so doing, convection heat transfer between an object and the fluid is promoted as a result of the surface velocity of the object relative to the fluid being at a maximum facing the radially outward region of the flowpath 26, where the flow velocity of the fluid is higher relative to the radially inward region of the flowpath 26 adjacent the impeller 28. However, the gear set could be modified so that the rotational direction 27 of each holder 22 and its object is in the same rotational direction as the drive gear 34, and therefore in the same rotational direction as the flow direction of the fluid along the flowpath 26 induced by the impeller 28. Though not shown, the walls 14 and/or 16 of the vessel 12 may be equipped with fins to confine and shape the flow of fluid within the vessel 12.

The apparatus 10 can be further seen in the drawings to comprise an optional reservoir 38 located along the axis 20 of the vessel 12 and surrounded by the flowpath 26 of the heat transfer fluid. The reservoir 38 is sized and configured for containing a heat sink, for example, ice, in order to cool the heat transfer fluid within the vessel 12. The reservoir 38 can be equipped with openings so that ice water formed by melting of ice in the reservoir 38 can enter the flowpath 26. Though the reservoir 38 is represented as centrally located within the vessel 12, additional and alternative locations for one or more reservoirs are foreseeable, and such reservoirs and locations are only limited by the ability of the heat sink within the reservoir(s) 38 to be in thermal contact with the heat transfer fluid within the vessel 12.

Other components of the apparatus 10 represented in the drawings include an optional screen 40 sized and configured to be placed in the vessel cavity 18 and positioned above the base wall 16 of the vessel 12, with holes 42 sized to receive at least the lower portions of the holders 22 and allow access to objects placed in the holders 22. In addition, a lid 44 is provided for closing an upper opening of the vessel 12, and through which the input shaft 30 passes.

FIGS. 4 through 7 contain graphs that evidence certain performance characteristics that were achieved with a prototype of the heat transfer apparatus represented in the drawings. To gauge the effectiveness of the apparatus, a targeted performance level was identified as the ability to cool a beverage within a twelve-ounce beverage can from room temperature to 40° F. or less in under 120 seconds using ice water at a temperature of about 35° F. as the heat sink. A Design of Experiments (DOE) was utilized to evaluate the prototype by altering three parameters and analyzing the output of the system. The parameters were actuation speed, actuation time, and number of cans ("actuation" refers to the rotation of the input shaft). In this nonlimiting example, the gear set was selected to have a 7:1 gear ratio, such that the beverage cans were rotated at a rotational speed seven times higher than the impeller. For each parameter, a high/low extreme was set at the limits of the operating range for the prototype. The response measured was the final temperature of one of the cans. Since the DOE was a full factorial design with three parameters, a total of eight tests were conducted. Each test run was randomized in order to limit the noise responses from the environment and the experiment. Below is a table showing parameters with its respective high/low value.

| Factors | Low Value | High Value |
|---|---|---|
| Actuation Speed | 45 rpm | 90 rpm |
| Actuation Time | 60 sec. | 120 sec. |
| No. of Cans | 2 | 5 |

Figure 4:
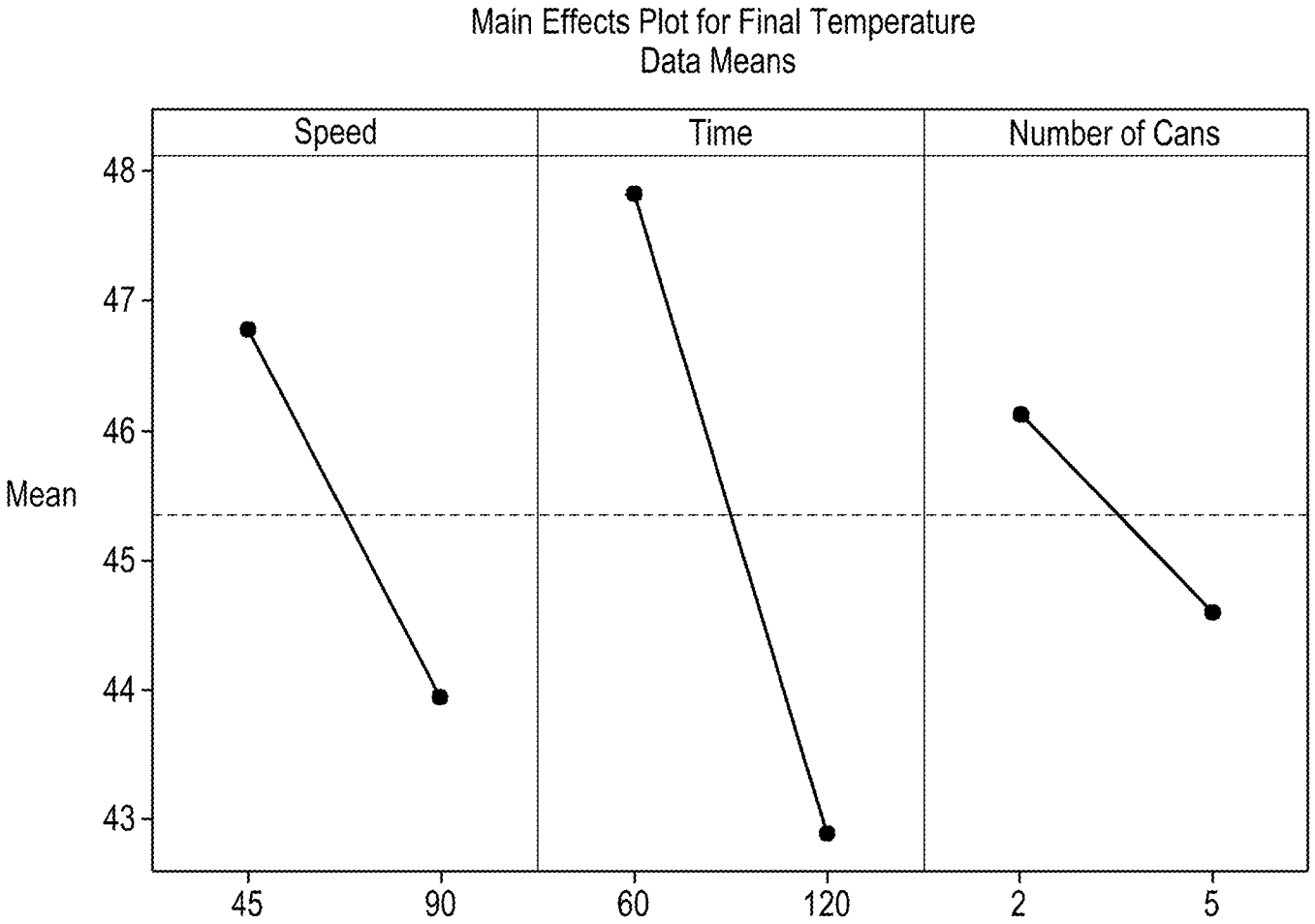
FIGS. 4, 5, 6, and 7 contain graphs depicting performance-related capabilities of an apparatus of the type represented in FIGS. 1 through 3.
Figure 5:
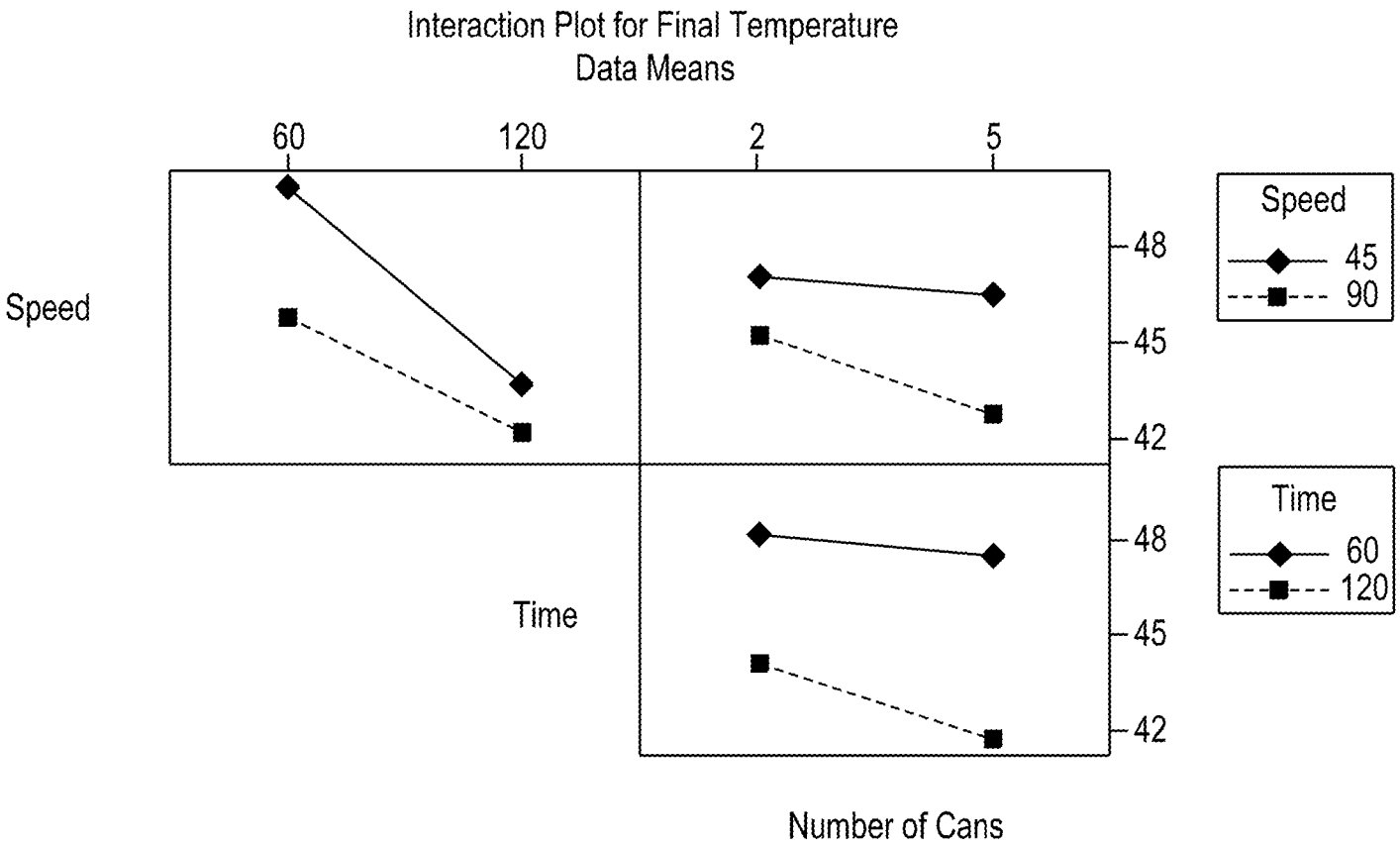
Figure 6:
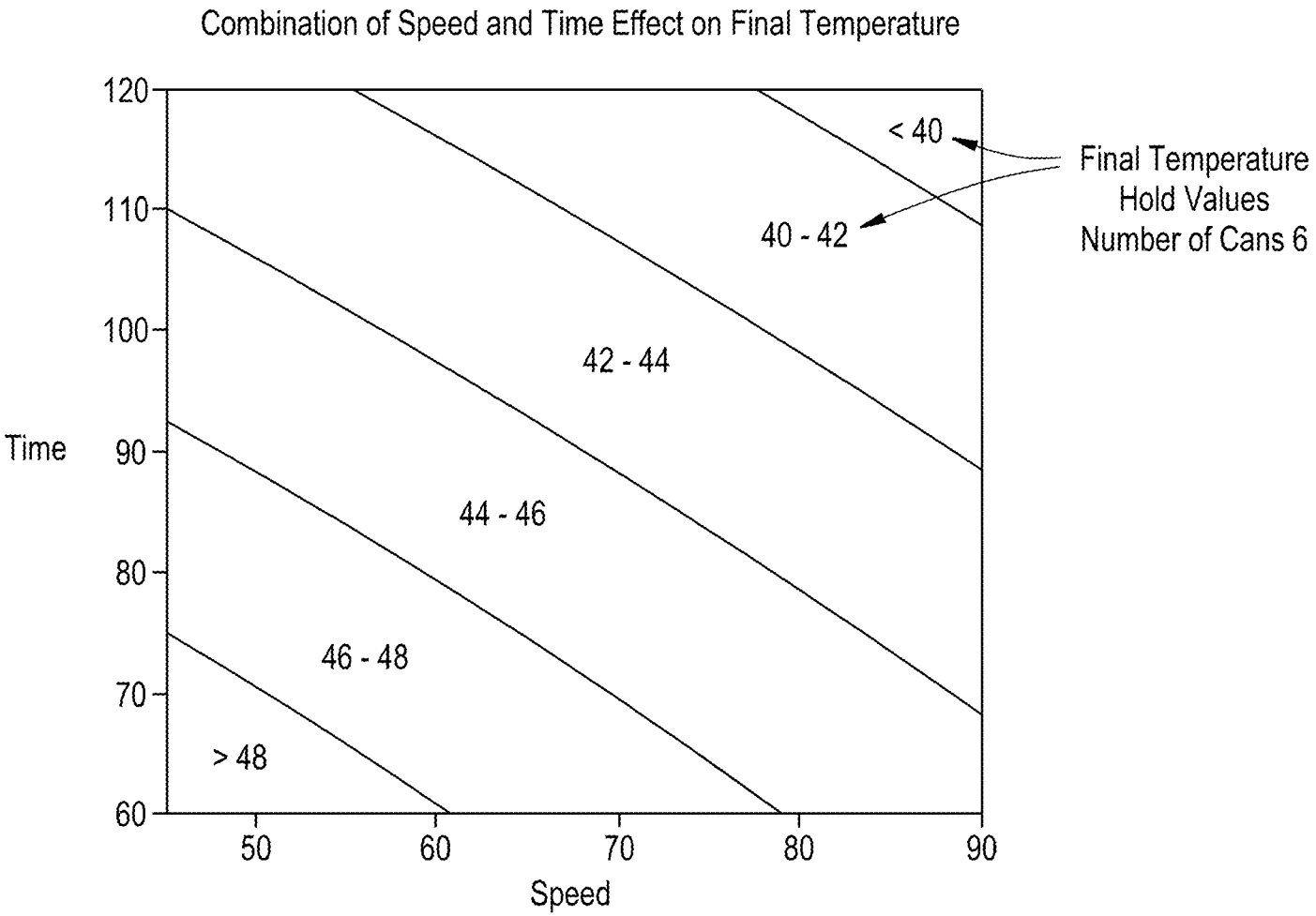

FIGS. 4, 5, and 6 contain main effects, interaction, and contour plots for the DOE. The graphs indicate how the parameters affected the final temperature and which factors were most and least significant. As can be seen in FIG. 4, actuation time and speed had the most significant effect on final temperature. Actuation time affected the final temperature by about 5° F. and actuation speed affected the temperature by about 4° F. The number of cans had a lesser impact, affecting the temperature by about 1° F. Surprisingly, cooling effect was increased with a greater number of cans. Though a higher thermal load corresponding to a greater number of cans might suggest a lower cooling rate, this was not the case and after further investigation the conclusion was that a higher number of cans improved the rotation of the water within the apparatus by separating the flowpath into two separate flow paths, allowing a higher relative velocity seen at the surfaces of the cans which increased forced convection heat transfer.

The graphs shown in FIG. 5 identify the interaction of actuation time and speed as the strongest between the three variables, indicating that the performance influence of both actuation time and actuation speed was affected by the level of the other. Actuation time and actuation speed did not have a significant interaction with the number of cans set in the experiment.

The contour plot of FIG. 6 was generated for actuation time and actuation speed. The number of cans was set constant at six for the experiment since the prototype apparatus was capable of holding a maximum of six cans. As can be seen, when the actuation speed and time were maximized, the temperature of the beverage was reduced to about 40° F., indicating that these variables must be maximized to achieve a drinking temperature of 34° F. or less, for example, by utilizing higher actuation speeds and/or different materials. The above results also suggested that increasing the number of cans accommodated by the apparatus could have a significant effect on the final temperature.

Figure 7:
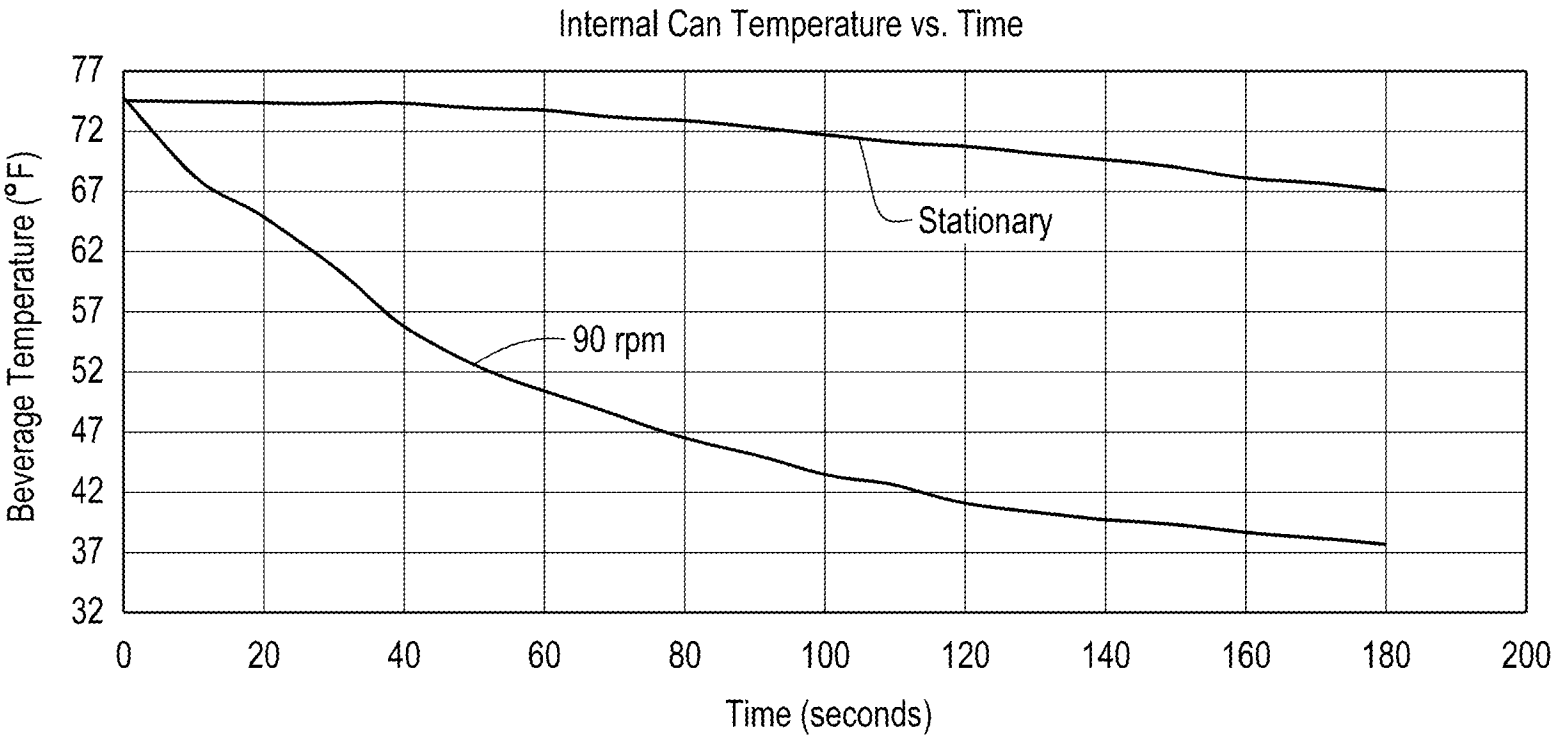

In addition to the DOE reported above, a temperature versus time evaluation was conducted to confirm the performance of the prototype apparatus as well as provide analytical data for temperature and time response. The following conditions were used for this experiment: beverage cans initially at room temperature (about 74° F.); ice water at a temperature of about 35° F. as the heat sink; an actuation speed of 90 rpm (630 rpm beverage can rotation); and an actuation time of three minutes (180 seconds). A high precision thermocouple was placed inside one of the cans for the entire duration of the test, and temperature readings were recorded every ten seconds. Also tested was an identical beverage can placed in stagnant ice water at the same temperature and for the same duration to simulate a traditional cooler. The results are represented in FIG. 7. After two minutes, the prototype apparatus had cooled the beverage to a temperature of about 40° F., which continued to drop to a temperature of 37° F. at three minutes. Such a result indicated that the addition of kinetic energy into the system during actuation and from friction was negligible.

FIG. 7 also indicates the lagging performance of cooling an identical beverage can in stagnant ice water. After being submerged for three minutes, the beverage had only dropped to about 67° F. The trends indicated in FIG. 7 suggest the prototype apparatus was capable of cooling rates nearly ten times faster that stagnant water.

In the nonlimiting situation in which carbonated beverages are being actuated as was done with the prototype apparatus, another consideration is the risk of agitating a carbonated beverage, resulting in excessive fizzing when opened. Carbonated beverages contain carbon dioxide dissolved in the liquid solution of the beverage. The dissolved carbon dioxide needs nucleation sites to change into a gas. When cans are shaken, an air pocket within the can is fragmented into many smaller pockets, allowing for much greater nucleation of carbon dioxide. However, the prototype apparatus rapidly rotated the beverage cans, forcing the liquids within the cans radially outward to likely result in a single central pocket during the cooling process. Because of a reduced number of nucleation sites, the carbon dioxide did not exit the liquid solution fast enough to cause the beverage to foam.

Figure 9:
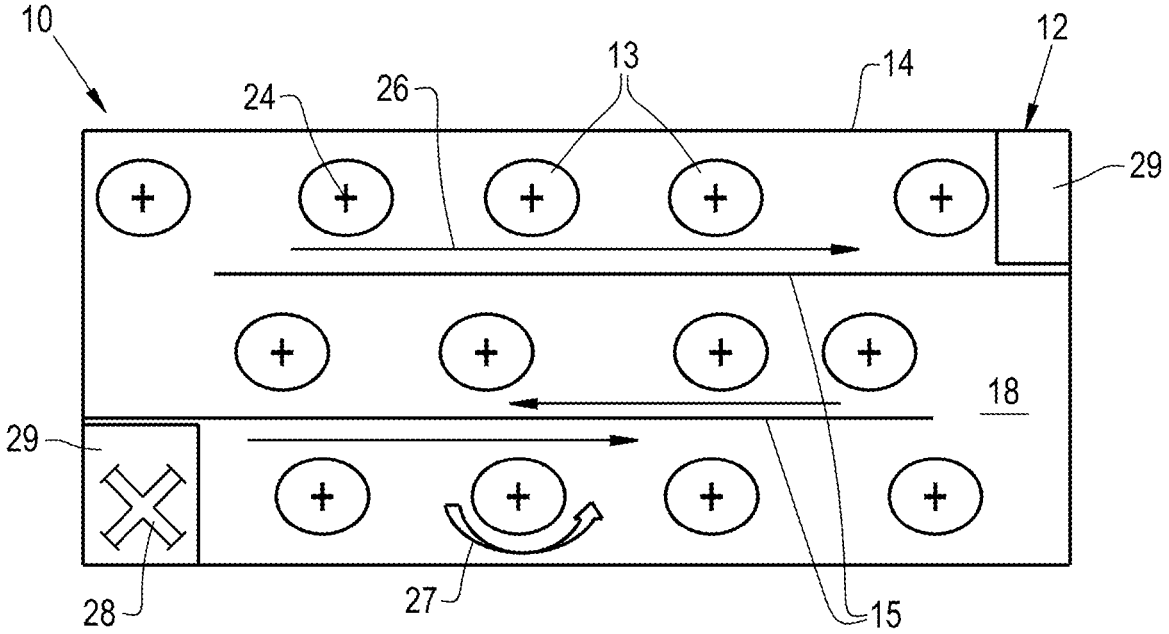
FIG. 9 schematically represents a plan view of a heat transfer apparatus in accordance with another alternative embodiment of an apparatus within the scope of the invention.

FIG. 9 schematically represents yet another alternative configuration for an apparatus 10 within the scope of the invention. The apparatus 10 represented in FIG. 9 utilizes the same basic principles as the apparatuses of FIGS. 1 through 3, but represents the external walls 14 of the vessel 12 as attributing a more traditional rectangular parallelepiped shape for the vessel 12 and its internal cavity 18. The vessel 12 further has internal walls 15 that, in combination with the external walls 14, define a serpentine flowpath 26 for a heat transfer fluid contained within the vessel 12. An impeller 28, which may be manually driven or driven with a motor, induces the heat transfer fluid to flow along the flowpath 26 as indicated by three arrows in FIG. 9. Multiple objects 13 (which may be containers that contain liquids) are placed within the flowpath 26 so that heat transfer occurs between the objects 13 and the heat transfer fluid. Each object 13 is secured with a holder (not shown), all of which are driven to cause the objects 13 to rotate about their respective axes 24, which in FIG. 9 are represented as a counterclockwise rotational direction 27. Due to the arrangement of the holders and impeller 28, a gear set (not shown) may be located beneath the cavity 18 to enable the holders to be rotated by the same means that rotates the impeller 28. Due to the serpentine configuration of the flowpath 26, a recycling duct (not shown) with openings 29 at opposite ends of the flowpath 26 may be provided so that the flowpath 26 is a segment of a continuous flowpath, of which a return segment may be located in a separate compartment below the cavity 18. A heat sink reservoir may be located within the separate compartment to transfer heat to or from the heat transfer fluid.

While the invention has been described in terms of particular embodiments and investigations, it should be apparent that alternatives could be adopted by one skilled in the art. For example, the apparatus 10 and its components could differ in appearance and construction from the embodiments described herein and shown in the drawings, functions of certain components of the apparatus 10 could be performed by components of different construction but capable of a similar (though not necessarily equivalent) function, process parameters such as temperatures and durations could be modified, and various materials could be used in the fabrication of the apparatus 10 and/or its components. As such, it should be understood that the above detailed description is intended to describe the particular embodiments represented in the drawings and certain but not necessarily all features and aspects thereof, and to identify certain but not necessarily all alternatives to the represented embodiments and described features and aspects. As a nonlimiting example, the invention encompasses additional or alternative embodiments in which one or more features or aspects of a particular embodiment could be eliminated or two or more features or aspects of different embodiments could be combined. Accordingly, it should be understood that the invention is not necessarily limited to any embodiment described herein or illustrated in the drawings, and the phraseology and terminology employed above are for the purpose of describing the illustrated embodiments and investigations and do not necessarily serve as limitations to the scope of the invention. Therefore, the scope of the invention is to be limited only by the following claims.

The invention claimed is:

1. An apparatus for modifying temperatures of multiple objects, the apparatus comprising:

a vessel having a cavity configured to contain a heat transfer fluid, the vessel having an axis associated therewith;

an impeller located within the cavity and coaxial with the axis of the vessel, the impeller inducing the heat transfer fluid in the cavity to circulate along a continuous flowpath in a rotational direction around the impeller and the axis of the vessel;

a reservoir within the cavity, located along the axis of the vessel, surrounded by the continuous flowpath of the heat transfer fluid, and contacted by the heat transfer fluid, the reservoir having openings so that contents of the reservoir enter the continuous flowpath of the heat transfer fluid;

a heat sink within the reservoir;

multiple means for individually securing each of the objects within the cavity so that the objects will contact the heat transfer fluid when contained by the cavity, each of the securing means having an axis of rotation and securing the objects so that each of the objects is at least partially disposed in the continuous flowpath of the heat transfer fluid; and means for individually rotating each of the objects about a corresponding one of the axes of rotation of the securing means.

2. The apparatus according to claim 1, wherein the objects are spaced from each other around the axis of the vessel and radially spaced from the axis of the vessel.

3. The apparatus according to claim 1, wherein the axis of the vessel is an axis of axial symmetry of the vessel, the cavity is cylindrical shaped, and the rotational direction of the heat transfer fluid is a circumferential direction of the cavity.

4. The apparatus according to claim 1, wherein the axes of rotation of the objects are approximately parallel to the axis of the vessel.

5. The apparatus according to claim 1, wherein the means for individually rotating each of the objects individually rotates the objects in rotational directions opposite the rotational direction of the heat transfer fluid.

6. The apparatus according to claim 1, wherein the multiple means for individually securing each of the objects are circumferentially spaced from each other around the axis of the vessel.

7. The apparatus according to claim 1, further comprising a drive gear coupled to the impeller and engaging the securing means to induce rotations of the securing means in the rotational directions thereof.

* * * * *